US010980343B2

(12) United States Patent
Boeckenstedt

(10) Patent No.: US 10,980,343 B2
(45) Date of Patent: Apr. 20, 2021

(54) SECURE STORAGE DEVICE

(71) Applicant: Bartholomew Boeckenstedt, Tacoma, WA (US)

(72) Inventor: Bartholomew Boeckenstedt, Tacoma, WA (US)

( * ) Notice: Subject to any disclaimer, the term of this patent is extended or adjusted under 35 U.S.C. 154(b) by 0 days.

(21) Appl. No.: 16/146,510

(22) Filed: Sep. 28, 2018

(65) Prior Publication Data

US 2019/0053621 A1 Feb. 21, 2019

Related U.S. Application Data

(63) Continuation-in-part of application No. PCT/US2017/024867, filed on Mar. 29, 2017.
(Continued)

(51) Int. Cl.

| | |
|---|---|
| ***A47B 83/04*** | (2006.01) |
| ***E05B 65/46*** | (2017.01) |
| ***E05G 1/08*** | (2006.01) |
| ***E05G 1/04*** | (2006.01) |
| ***E05G 1/024*** | (2006.01) |
| ***G07C 9/25*** | (2020.01) |

(Continued)

(52) U.S. Cl.

CPC ..... *A47B 83/045* (2013.01); *A47B 13/081* (2013.01); *A47B 88/473* (2017.01); *E05B 47/0012* (2013.01); *E05B 65/46* (2013.01); *E05C 9/08* (2013.01); *E05C 9/10* (2013.01); *E05G 1/024* (2013.01); *E05G 1/04* (2013.01); *E05G 1/08* (2013.01); *G07C 9/257* (2020.01); *E05B 2047/0017* (2013.01); *E05Y 2900/20* (2013.01); *G07C 9/26* (2020.01)

(58) Field of Classification Search

CPC ... A47B 83/045; A47B 13/081; A47B 88/473; A47B 1/02; A47B 1/03; A47B 1/05; A47B 46/00; G07C 9/257; G07C 9/26; G07C 9/00563; G07C 9/25; G07C 9/37; E05G 1/024; E05G 1/04; E05G 1/08; E05C 9/10; E05C 9/08; E05Y 2900/20; E05B 2047/0056; E05B 2047/0024; E05B 2047/0025

See application file for complete search history.

(56) References Cited

U.S. PATENT DOCUMENTS

| | | | | |
|---|---|---|---|---|
| 895,640 | A * | 8/1908 | Hullhorst | A47B 53/02 312/201 |
| 4,893,885 | A * | 1/1990 | Borello | A47B 31/00 312/249.9 |

(Continued)

OTHER PUBLICATIONS

Rustic Oak Storage Coffee Table with Sliding Top and Drawers, Sarta.co.uk. Apr. 13, 2015 US.

*Primary Examiner* — Hiwot E Tefera
(74) *Attorney, Agent, or Firm* — Standley Law Group LLP; Beverly Marsh; Adam Smith

(57) ABSTRACT

A secure storage device contains multiple compartments under a table top. The table top may move laterally to allow authorized users to access storage areas. A drawer in the device may also be accessed by an authorized user. The movement of the table top and drawer is directed by a central computer in communication with a biometric sensor located on the device. The central computer may be programmed to allow different types of access to the device based upon fingerprints or other biometric information from a user.

20 Claims, 12 Drawing Sheets

Related U.S. Application Data

(60) Provisional application No. 62/314,904, filed on Mar. 29, 2016.

(51) Int. Cl.

| | |
|---|---|
| ***A47B 88/473*** | (2017.01) |
| ***A47B 13/08*** | (2006.01) |
| ***E05B 47/00*** | (2006.01) |
| ***E05C 9/08*** | (2006.01) |
| ***E05C 9/10*** | (2006.01) |
| *G07C 9/26* | (2020.01) |

(56) References Cited

U.S. PATENT DOCUMENTS

D331,334 S * 12/1992 Hollington ..... D6/667
6,209,977 B1 * 4/2001 Vondrejs ..... A47B 85/08 312/249.9
9,534,422 B1 * 1/2017 Andersen ..... A47B 81/00
9,962,316 B2 * 5/2018 Latorraca ..... A61J 7/0084
2002/0078865 A1 * 6/2002 Kuvshinikov ..... A47B 46/00 108/143
2004/0123780 A1 * 7/2004 Butts, Jr. ..... A47B 3/0912 108/26
2004/0173127 A1 * 9/2004 Chiang ..... A47B 1/02 108/84
2005/0251687 A1 11/2005 Bachinski et al.
2010/0111598 A1 * 5/2010 Baur ..... E05B 63/123 403/348
2011/0001407 A1 * 1/2011 Stradiota ..... E05G 1/08 312/237
2011/0074543 A1 * 3/2011 Kaczmarz ..... G06Q 10/087 340/5.73
2011/0199183 A1 * 8/2011 Marsden ..... G07C 9/00563 340/5.52
2015/0250312 A1 * 9/2015 Barrett ..... A47B 88/463 312/319.1
2016/0138300 A1 * 5/2016 Dias ..... E05B 47/026 70/85
2017/0356219 A1 * 12/2017 Roatis ..... E05B 47/0692
2018/0216369 A1 * 8/2018 Roatis ..... E05B 65/462

* cited by examiner

SECURE STORAGE DEVICE

CROSS-REFERENCE TO RELATED APPLICATIONS

This application is a continuation-in-part of and claims the filing benefit of PCT Application No. PCT/US2017/024867 having an international filing date of Mar. 29, 2017, which claims the benefit of U.S. Provisional Application No. 62/314,904, filed Mar. 29, 2016, and makes a claim of priority thereto. The entire contents of the '904 provisional application and the '867 PCT application are hereby incorporated by reference as if fully recited herein.

TECHNICAL FIELD

Exemplary systems, devices, and methods are directed to secure storage.

BACKGROUND AND SUMMARY

Many people own guns, jewelry, and other dangerous or valuable objects that they wish to keep securely hidden from view in their homes. However, it is difficult to securely store items in devices that require a passcode or physical key, as passcodes and keys may be difficult to locate or remember, especially in an emergency. Particularly for gun owners, who may wish to access a gun quickly in the event of a home invasion or other safety threat, it is desirable to be able to access a storage device without having to locate a key or remember a code.

It is also desirable to remotely monitor the status of a storage device and determine if it is open or closed, as well as to be able to open or close a storage device remotely. It is further desirable to be able to monitor which person(s) may have access to a storage device.

Homeowners who desire quick access to their valuables recognize that it is ideal if such valuables are stored in the main living quarters, hidden in "plain sight." This allows homeowners to easily and quickly access their belongings without having to walk down to a basement, attic, or closet where many people otherwise store their guns and valuables.

Exemplary embodiments described herein address these problems and more. Exemplary embodiments provide a secure storage device that uses a biometric sensor to ensure that only approved persons can access stored objects. Exemplary embodiments provide a secure storage device with multiple compartments, allowing for access to each compartment to be monitored, recorded, and only given to authorized persons. Exemplary embodiments also provide a device that can be used as a coffee table, has a bidirectional table top that can move in two directions to provide access to multiple compartments, and also has a drawer for storage.

Other aspects and features of the invention will become apparent to those skilled in the art upon review of the following detailed description of exemplary embodiments along with the accompanying drawing figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF THE EXEMPLARY EMBODIMENTS

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 2:
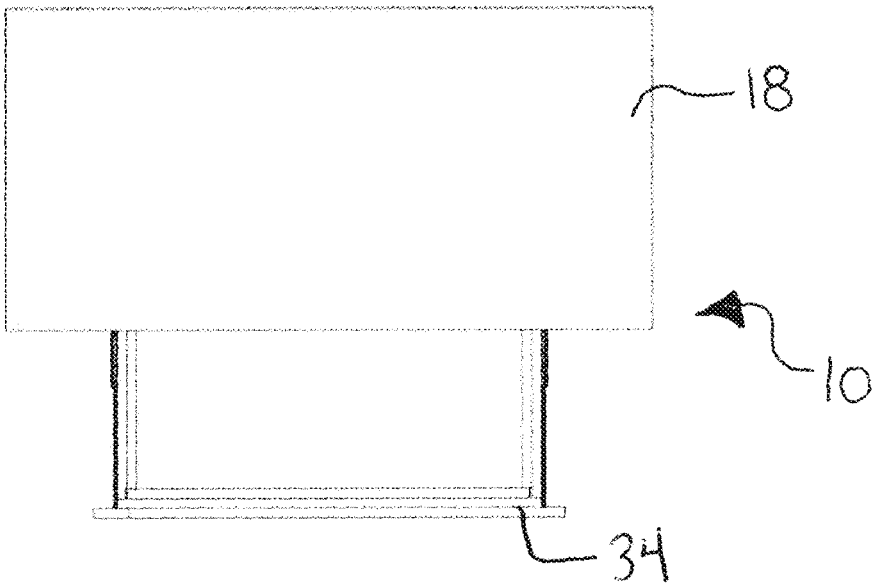
FIG. 2 is a top plan view of the device of FIG. 1, wherein the drawer is in an open position.
Figure 3:
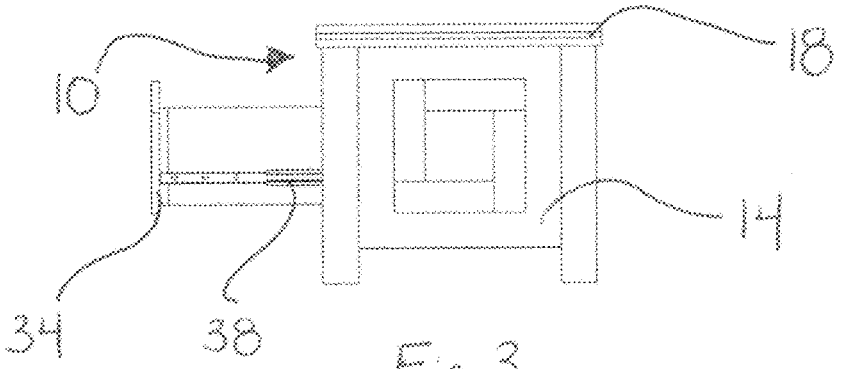
FIG. 3 is a side elevational view of the device of FIG. 1, wherein the drawer is in an open position.

Referring to the figures, an exemplary embodiment of a storage device is shown. As shown in at least FIGS. 1-3, the device 10 may be comprised of a generally rectangular outer chest 12 having four sides 14 including a front side 15, a bottom 16, a table top 18, and four legs 20. The four sides 14 and bottom 16 may define a generally rectangular inner cavity 22. The table top 18 may be horizontally disposed above the inner cavity 22 and has a generally planar surface. However, any size or shape device 10 is contemplated.

Internally, the device 10 may be generally comprised of an upper compartment 30 and a lower compartment 32. A drawer 34 may be located in the lower compartment 32, and the drawer 34 may be slidably mounted to the chest 12 such that it opens through an aperture 36 in the front side 15 of the outer chest 12. The drawer 34 may be slidably mounted to the chest 12 through a pair of drawer slide assemblies 38 located on either side of the drawer 34.

The upper compartment 30 of the chest 12 may contain two storage areas 40 separated from one another and defined in part by a central motor compartment 42 that spans the inner depth of the upper compartment 30. A shelf 41 may provide the bottom surface for the two storage areas 40 and the central motor compartment 42.

Figure 1:
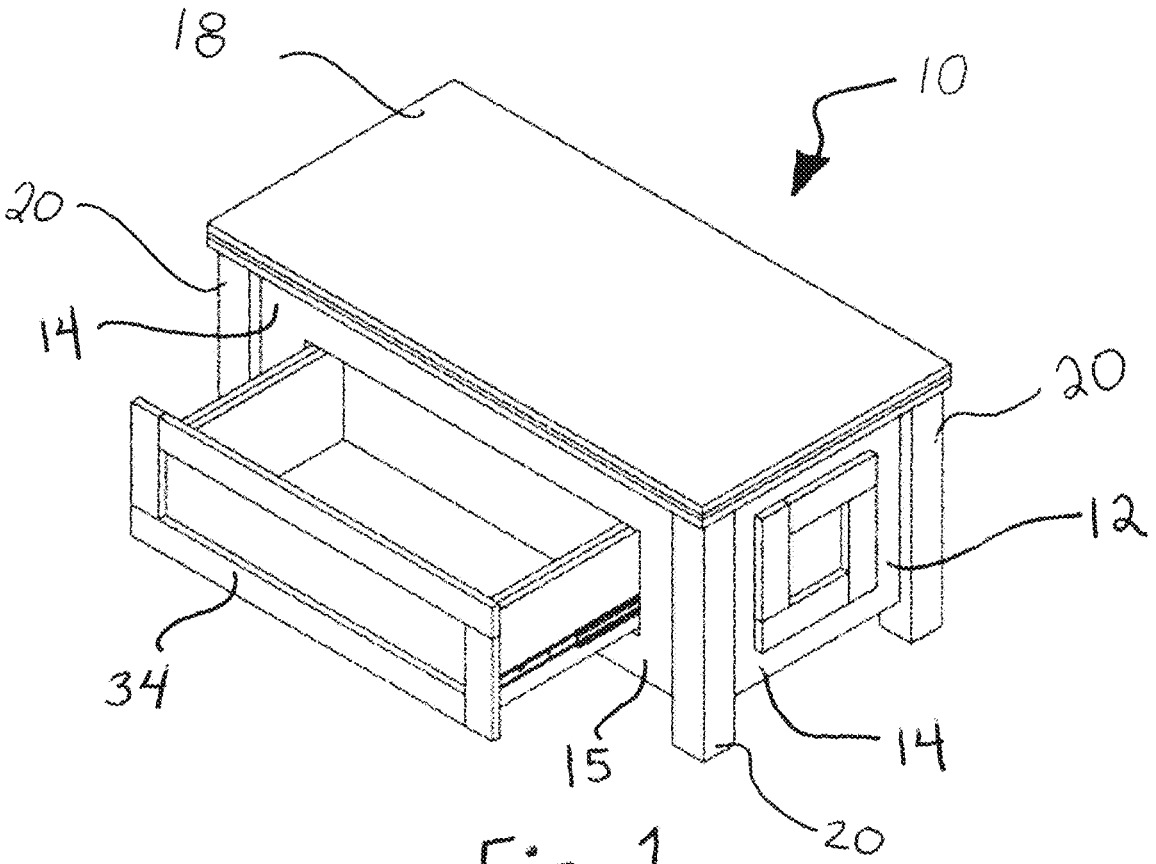
FIG. 1 is a perspective view of an exemplary embodiment of a secure storage device, wherein the drawer is in an open position.
Figure 7:
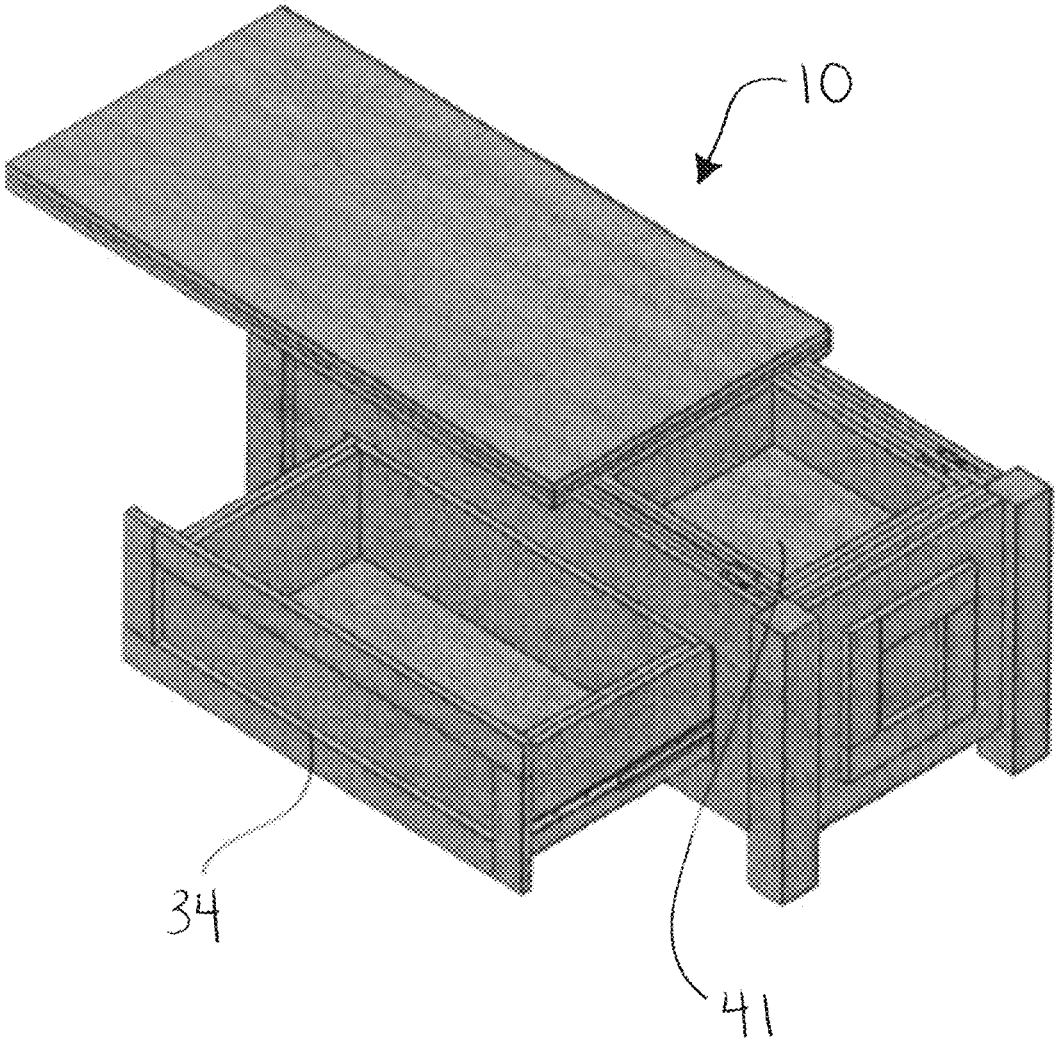
FIG. 7 is a perspective view of the device of FIG. 1, with the drawer and table top in open positions.
Figure 8:
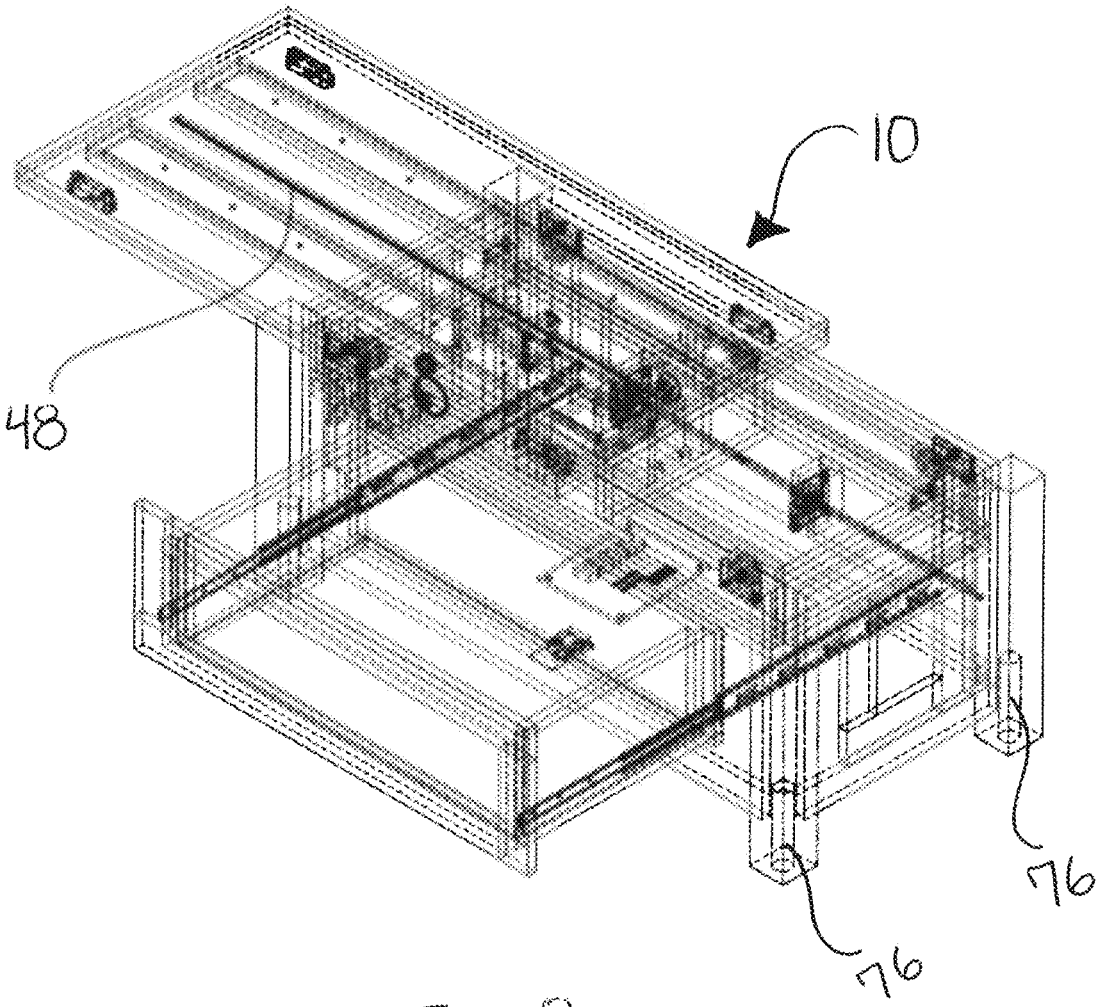
FIG. 8 is an illustration of a perspective view of the device of FIG. 1, with the drawer and table top in open positions and surfaces transparent.
Figure 9:
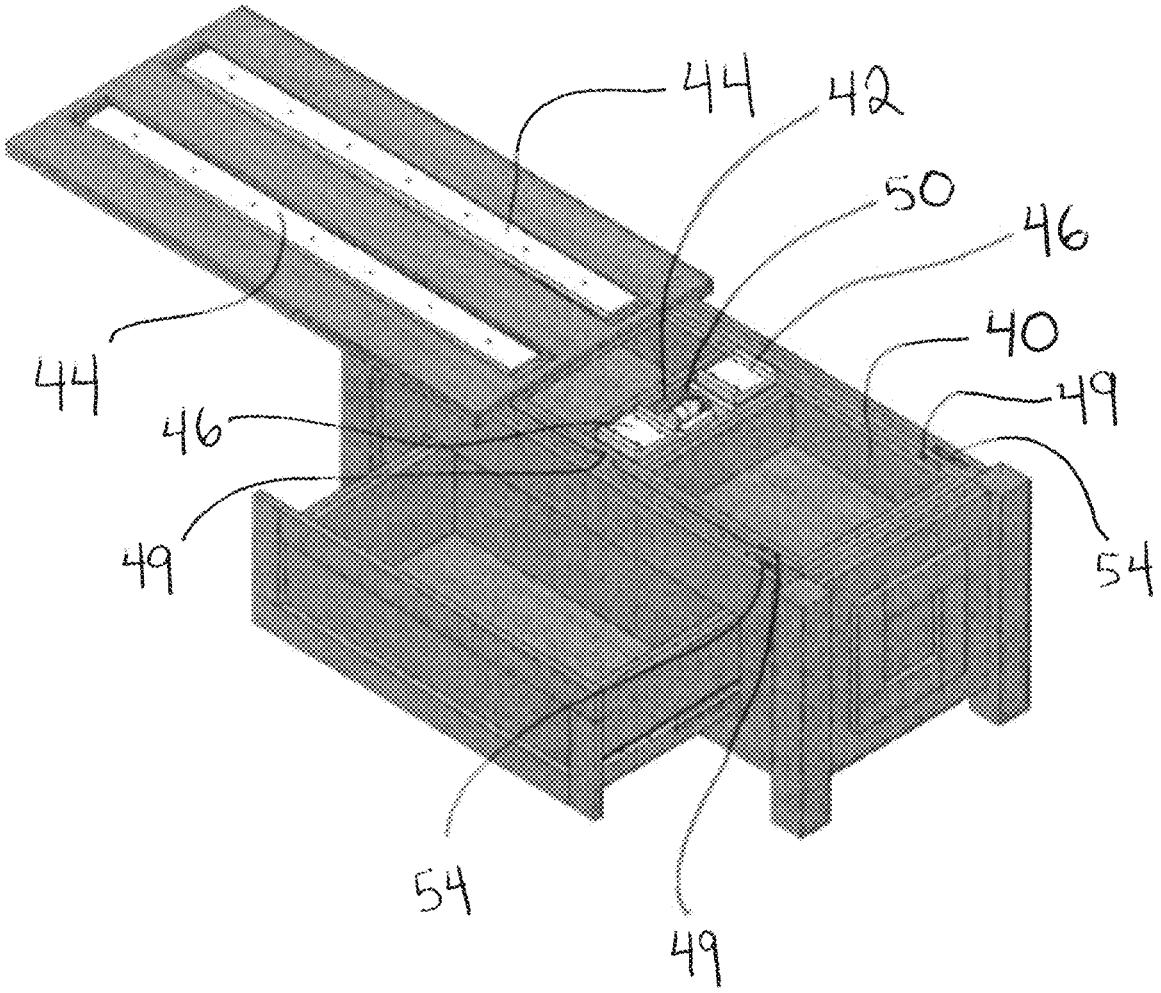
FIG. 9 is a perspective view of the device of FIG. 1, with the drawer in an open position and the table top in an exaggerated open position and with top layers of the table top and bottom surface of the storage areas omitted.
Figure 10:
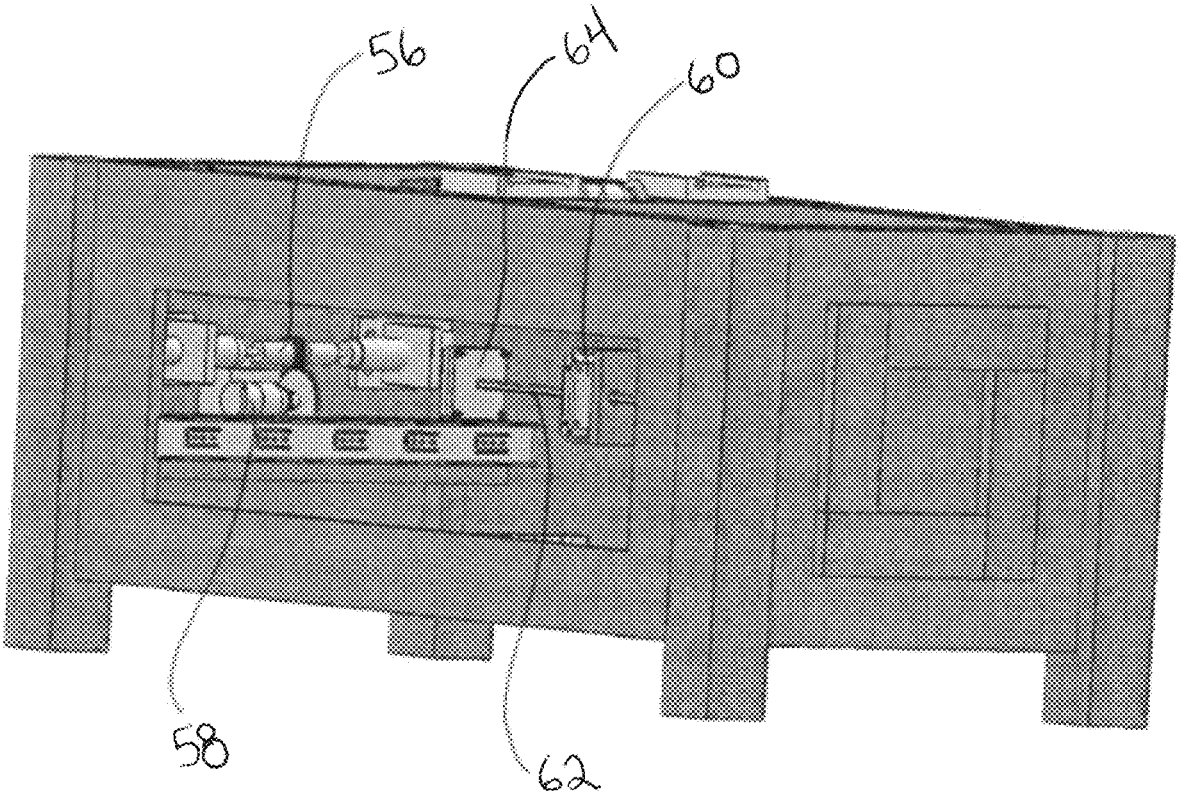
FIG. 10 is a perspective view of the device of FIG. 1, with the drawer and table top omitted.

The table top 18 is able to move relative to the inner cavity from a closed position, wherein it covers the entire inner cavity 22, as shown in FIG. 1, for example, to an open position, wherein the inner cavity 22 is at least partially exposed such that the contents of at least one of the storage areas 40 may be accessed by a user. FIGS. 7-9 illustrate the table top 18 in an open position, wherein any storage areas 40 may be accessed. The table top 18 may move in either direction, and to varying extents as desired. The table top 18 may only open enough in either direction to expose just one storage area 40 at a time. Depending on the embodiment, different numbers and configurations of storage areas 40 may exist in the upper compartment 30.

Figure 18:
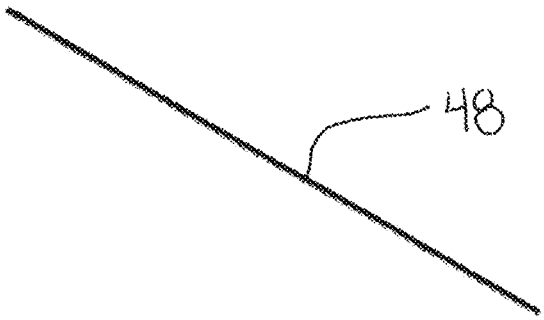
FIG. 18 is a perspective view of an exemplary embodiment of a rack.

The means for moving the table top 18 is illustrated in at least FIGS. 4, 7, 8, 9, and 11. Two rail slides 44 may be located on the bottom surface of the table top 18 in parallel fashion. Each rail slide 44 may be positioned to slidably engage with one of two rail slide carriages 46 located in the motor compartment 44. The rail slide carriages 46 may guide the movement of the table top 18 from a closed to open position, and vice versa. The movement of the table top 18 may be actuated by a rack and pinion assembly. A rack 48 may be located on the bottom surface of the table top 18, such as, without limitation, in between the rail slides 44. An exemplary embodiment of a rack is shown in FIG. 18. A pinion motor 50 may be positioned inside the motor compartment 44 such that when in operation gears attached to the pinion motor 50 may engage with the rack 48 on the bottom surface of the table top 18 and induce lateral movement of the table top 18. Any location of the rack 48 and corresponding location of the pinion motor 50 is contemplated. In other exemplary embodiments different assemblies and means may be used to cause and guide movement of the table top. In other exemplary embodiments, the pinion motor 50 and rack 48 may not be required and instead the table top 18 may be moved manually.

Figure 4:
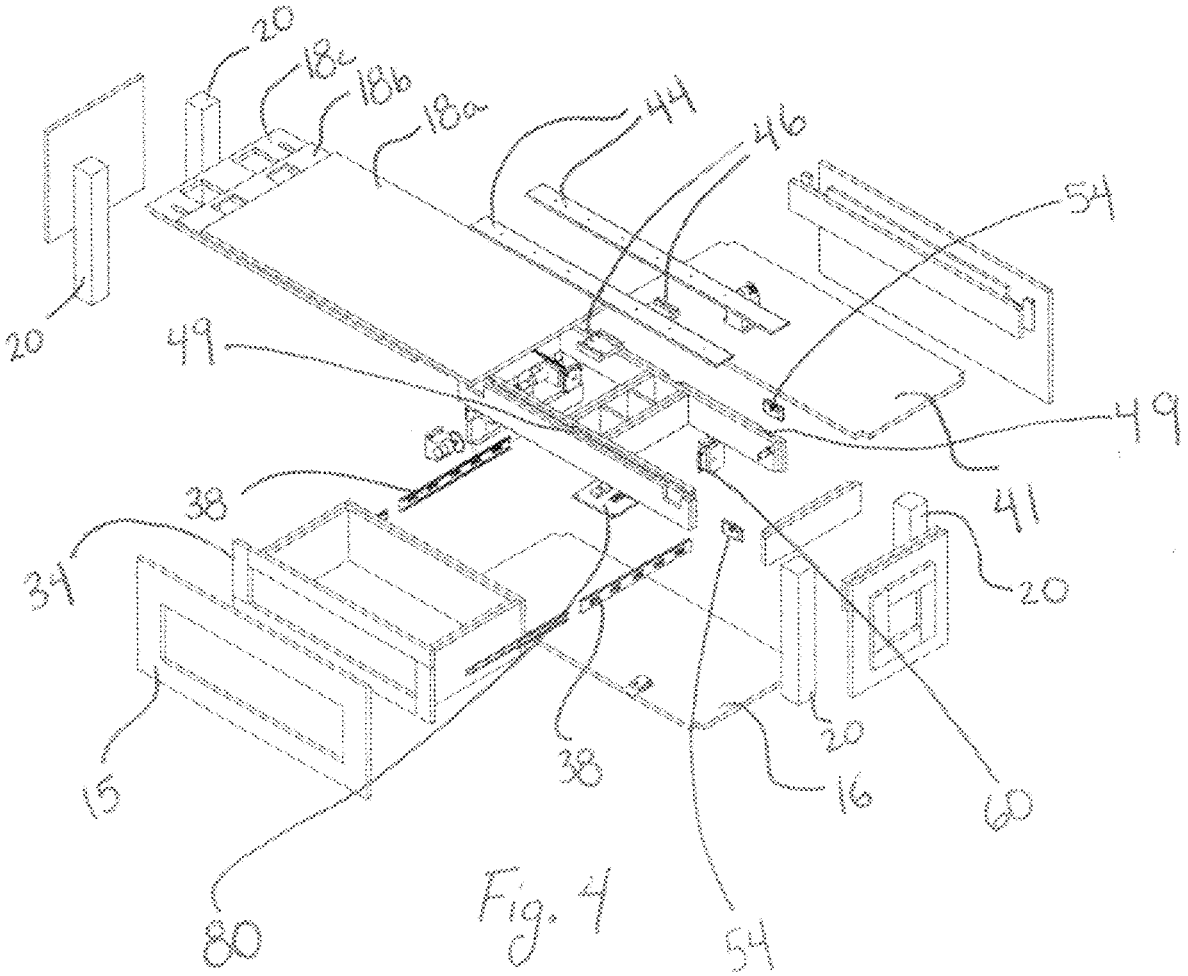
FIG. 4 is an exploded perspective view of the device of FIG. 1.
Figure 5:
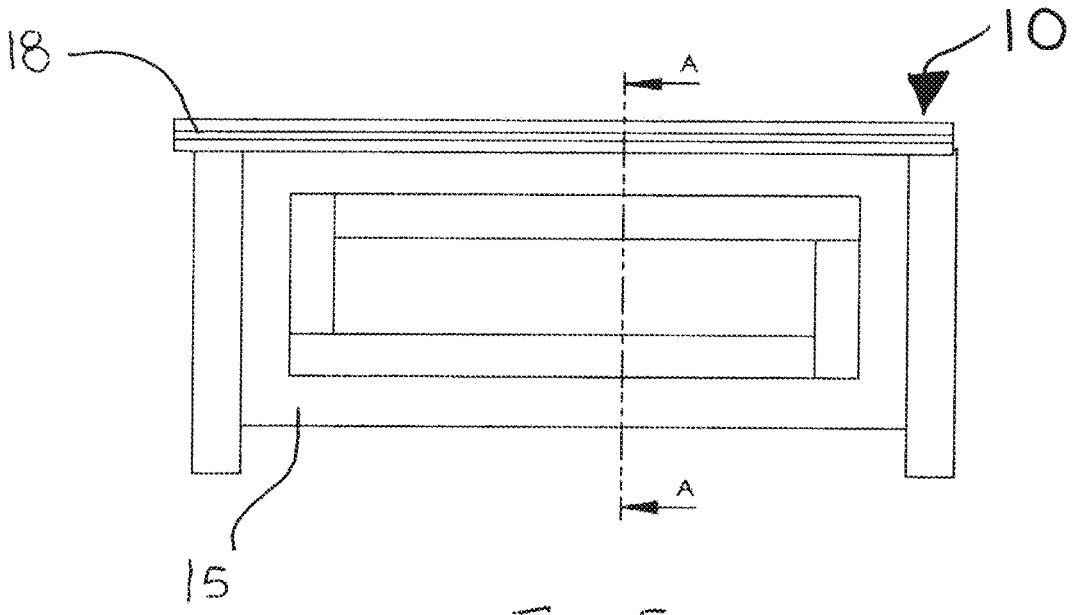
FIG. 5 is a front elevational view of the device of FIG. 1, with the drawer in a closed position.
Figure 6:
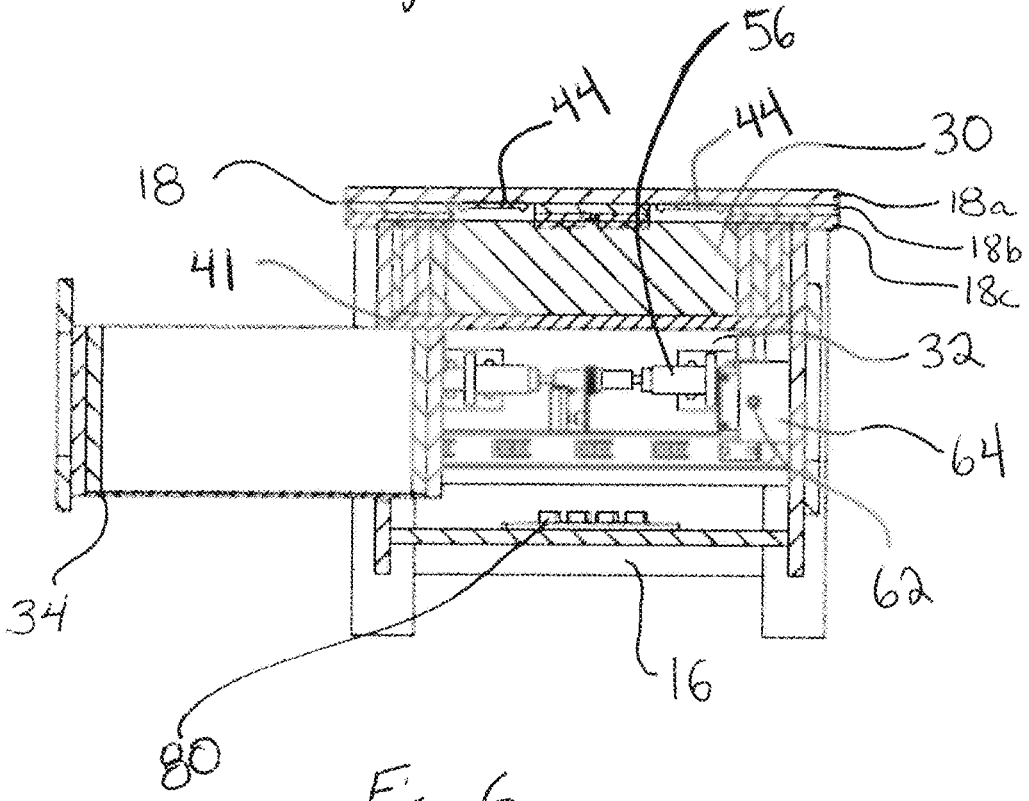
FIG. 6 is a cross-sectional view of the device of FIG. 1, taken along line A-A of FIG. 5.

As illustrated in FIGS. 4-6, in exemplary embodiments the table top may be comprised of multiple layers 18*a*, 18*b*, and 18*c*, and the middle and bottom layers 18*b*, 18*c*, may contain apertures 52 sized and positioned to accept the rail slides 44 and allow the rail slides 44 to be recessed. This may provide sufficient clearance to the rail slides 44 such that the table top 18 slides smoothly over the four sides 14 of the chest 12 and without obstruction. Rollers 49 may protrude from the top surface of the front and back sides 14 of the chest also aid in allowing the table top to move smoothly. FIG. 9 shows the table top 18 in an open position, exaggerated to allow viewing of the motor compartment 42, with the top layer 18*a* of the table top omitted, exposing the rail slides 44 for view. In some embodiments a single rail slide 44 and a single rail slide carriage 46 may be used to guide the movement of the table top 18.

Figure 11:
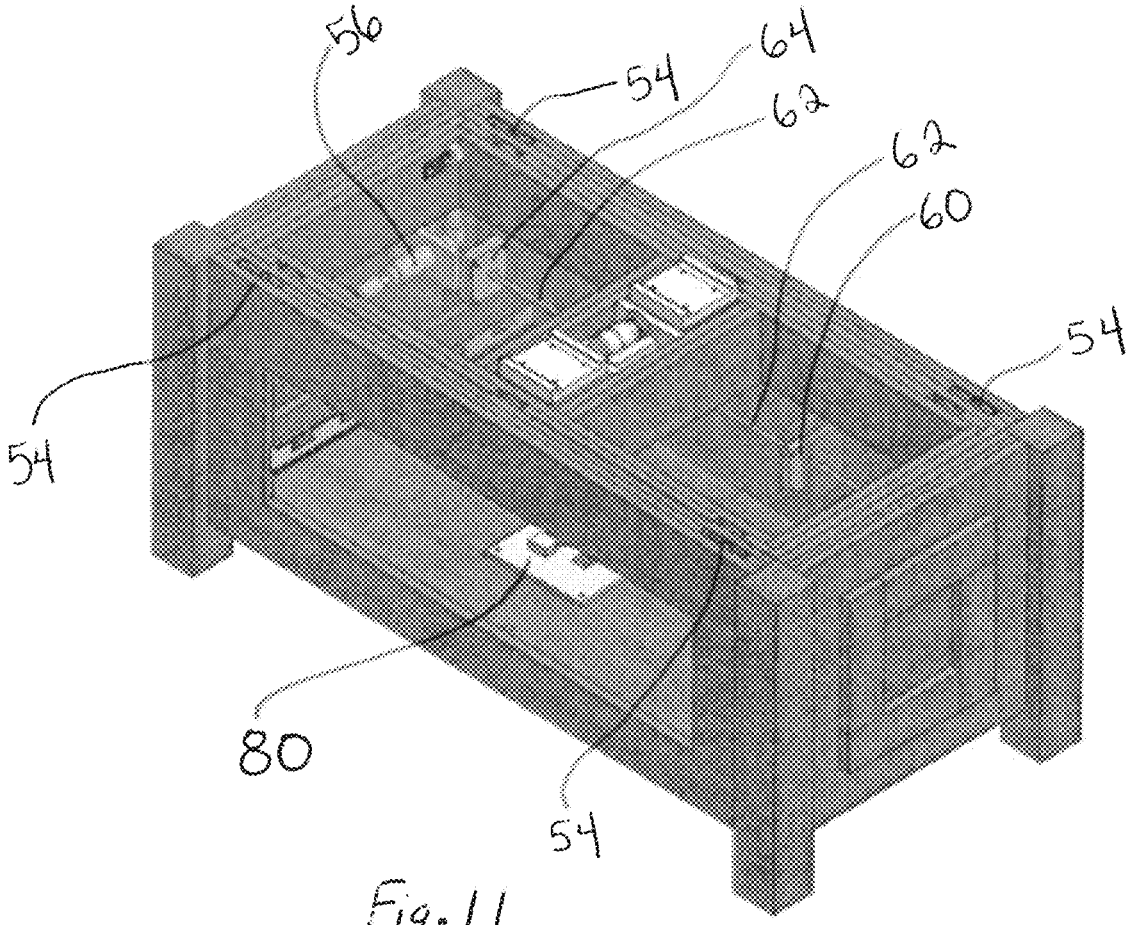
FIG. 11 is a perspective view of the device of FIG. 1, with the drawer, table top, and bottom surfaces of the storage areas omitted.
Figure 12:
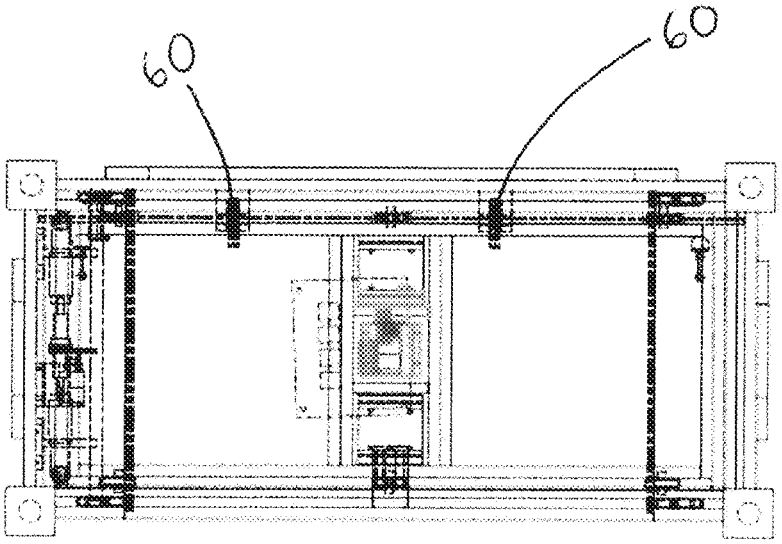
FIG. 12 is an illustration of a top plan view of the device of FIG. 1, with surfaces transparent.
Figure 13:
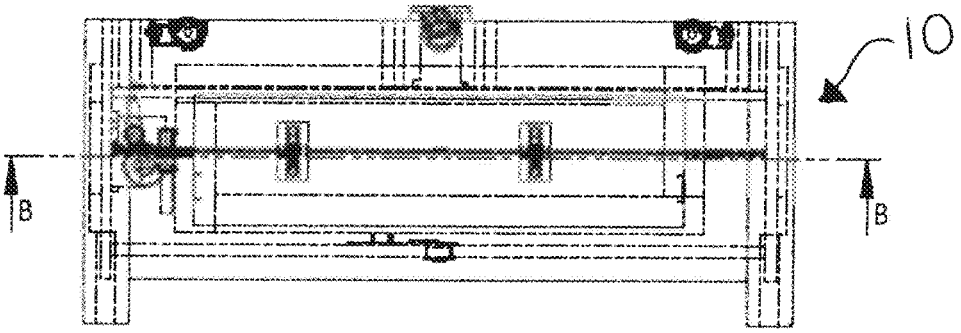
FIG. 13 is an illustration of a front elevational view of the device of FIG. 1, with table top omitted and surfaces transparent.
Figure 14:
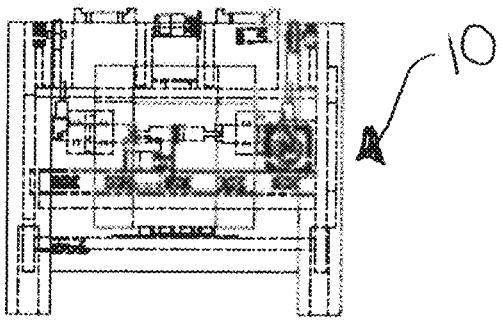
FIG. 14 is an illustration of a side elevational view of the device of FIG. 1, with table top omitted and surfaces transparent.
Figure 15:
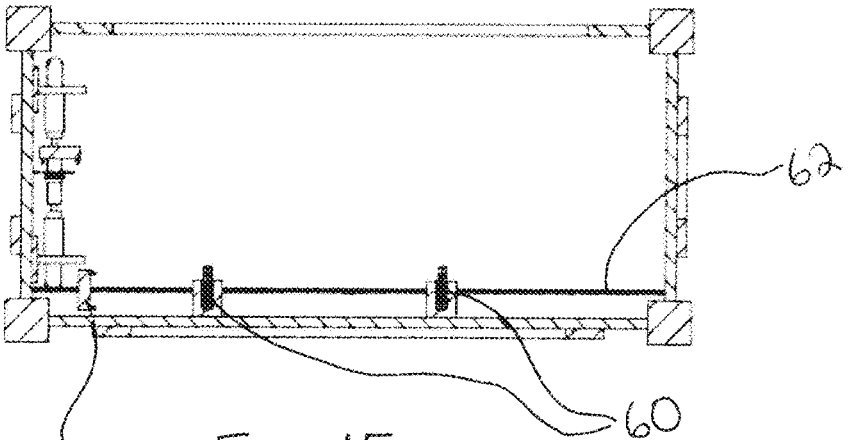
FIG. 15 is a top cross-sectional view of the device of FIG. 1, taken along line B-B of FIG. 13.
Figure 16:
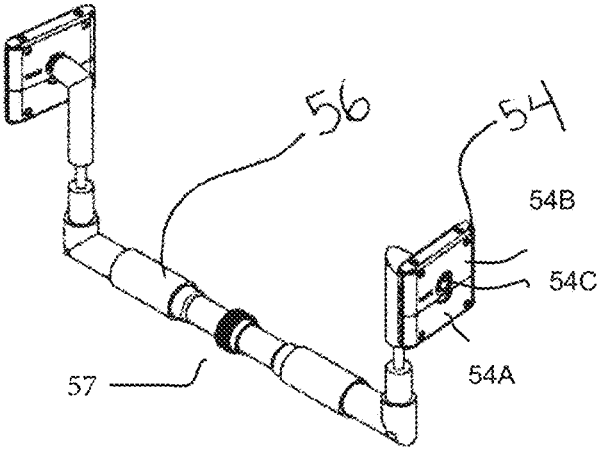
FIG. 16 is a perspective view of a cam lock mechanism.
Figure 17:
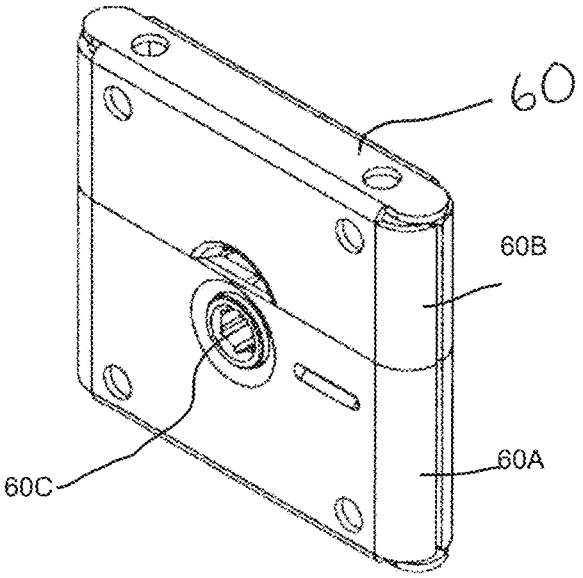
FIG. 17 is a perspective view of a cam lock of an exemplary embodiment.

Referring to FIG. 4, and as also shown in FIGS. 11 and 16, the table top 18 may be selectively secured into a position by four cam lock mechanisms 54. The four cam lock mechanisms 54 may be located in proximate location to each of the four corners of the device 10. An upper portion of the cam lock 54A may be located at least partially within the table top 18, while a lower portion of the cam lock 54B may be located at least partially within the sides of the chest 12. Alternatively, the lower portion of the cam lock 54B may be located at least partially within the table top 18 while the upper portion of the cam lock 54A may be located at least partially within the sides of the chest 12. Operation of the cam lock mechanisms 54 may be controlled by a pair of 90-degree drives 56, wherein each of the drives 56 is associated with a motor 58. The drives 56 and associated motors 58 may be positioned on each end of the device 10 and may operate the two cam lock mechanisms 54 on their respective end (drive and mechanism on one end not shown).

The drives 56 may comprise one or more drive mechanisms 57, such as but not limited to a gear, for coupling to a motor 58. Such coupling may be done directly or indirectly, such as through associated equipment (e.g., gears, belts, chains, racks, pinions, cams, levers, etc.) Regardless, operation of the motor may engage the drive mechanisms 57 and cause rotation of the drives 56, which may in turn result in rotation of, or other engagement with, a locking mechanism 54C for the respective cam lock(s) 54. Such engagement of the locking mechanism 54C may cause a locking device to be rotated or otherwise moved between a locked position and an unlocked position. In the locked position, the locking mechanism 54C may be operated such that the lower portion 54A of the cam lock 54 is secured to the upper portion 54B of the cam lock 54. In this way, the table top 18 may be prevented or otherwise obstructed from movement such that the compartments 30 and 32 located thereunder may not be accessed. In the unlocked position, the locking mechanism 54C may be operated such that the lower portion 54A of the cam lock 54 is not secured to the upper portion 54B of the cam lock 54. In this way, the table top 18 may be moved such that the compartments 30 and 32 located thereunder may not be accessed.

Referring to FIGS. 10-15 and 17, the drawer 34 may be secured by one or more cam locks 60 located within the lower compartment 32. The cam locks 60 and 54 may be identical or different. Each of the cam locks 60 may comprise a lower portion 60A comprising a locking mechanism 60C. The cam locks 60 may further comprise an upper portion 60B. The upper portion 60B of the cam lock 60 may be located in the drawer 34 and the lower portion 60A of the cam lock 60 may be located along a rear wall of the chest 12. Alternatively, the lower portion 60A of the cam lock 60 may be located in the drawer 34 and the upper portion 60B of the cam lock 60 may be located on a rear wall of the chest 12.

A hex long bar 62 may be located along the rear wall of the chest 12 such that the cam locks 60 may be mounted thereto. The hex long bar 62 may extend through each locking mechanism 60C of the respective cam lock 60 and may be rotated or otherwise operated by a dedicated motor. Alternatively, or in addition, the hex long bar 62 may be rotated or otherwise operated, directly or indirectly, by the motor 58. Regardless, rotation of the hex long bar 62 may cause the upper portions 60B and lower portions 60A of the cam locks 60 to engage or disengage one another similar to as described with regard to FIGS. 4, 11, and 16 above, depending on the direction of rotation of the hex long bar 62. When the cam locks 60 are engaged, the respective locking devices 60C may be configured to engage the lower and upper portions 60A and 60B with one another to prevent or otherwise obstruct movement of the drawer 34 and prevent it from being opened. Similarly, when the cam locks 60 are disengaged, the respective locking devices 60C may be configured to selectively disengage the lower and upper portions 60A and 60B with one another to permit movement of the drawer 34 and allow it to be opened.

Figure 19:
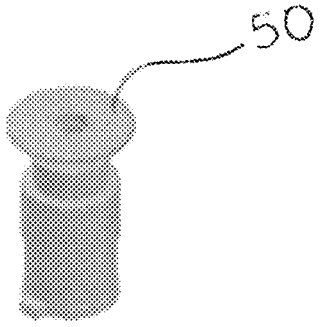
FIG. 19 is a perspective view of a pinion motor.
Figure 21:
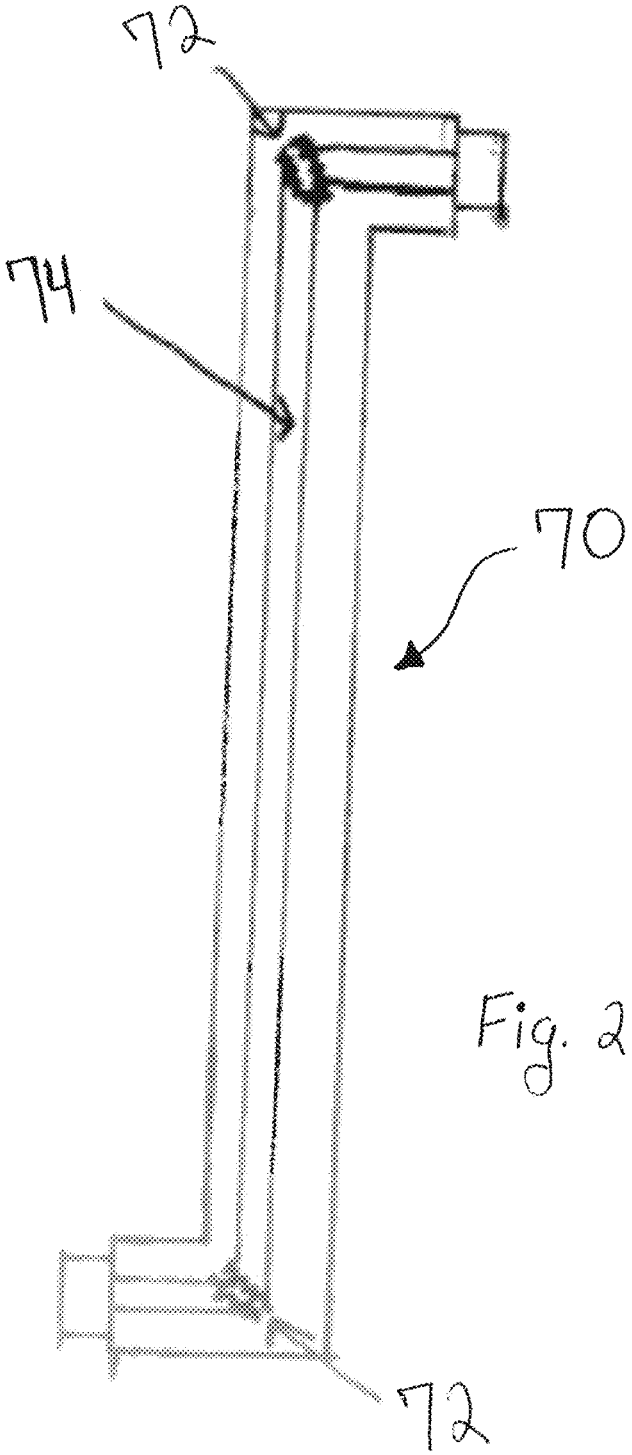
FIG. 21 is a side view of an embodiment of an offset parallel drive shaft.

An embodiment of 90-degree drive assembly 56 is shown in FIG. 16. In other embodiments different types of locks and latches may be used to hold the table top and drawer 34 in secured or "closed" positions. FIG. 19 is an exemplary embodiment of the pinion motor 50 that may be used to operate the table top 18. FIG. 21 illustrates an offset parallel drive shaft 70 comprising two 90-degree gears 72 on either end of an internal shaft 74 that may be used in some embodiments instead of a pair of 90-degree drives.

In an exemplary embodiment, operation of each motor (e.g., pinion motor 50 and motor 58) may be controlled by a central computer 80 located inside the lower compartment 32. The central computer 80 may comprise a processor, network communications device, and electronic storage device. The electronic storage device may be a non-transitory storage medium and may comprise software instructions, which when executed cause the processor to perform various functions as described herein. Information may be communicated to one or more remote devices by way of the network communication device which may be connected to such remote devices by way of a network such as the internet, intranet, cellular network, world wide web, or the like. Such remote devise may include, but are not limited to, a smartphone, tablet, personal computer, smart watch, or the like. Connection of the network connection device to the network may be made by wired or wireless connection.

The central computer 80 may be located underneath the front drawer 34 as shown in FIG. 11, although in other embodiments the central computer 80 may be in a different location. In some exemplary embodiments the motors are hard wired to the central computer 80, and in other embodiments the motors communicate with the central computer 80 through wireless means. The central computer 80 may be configured to control operation of the respective motors to cause the table top 18 and the drawer 34 to lock, and the table top 18 to move. However, it is contemplated that the central computer 80 may be configured to control operations of any of the respective motors individually or in combination.

Figure 20:
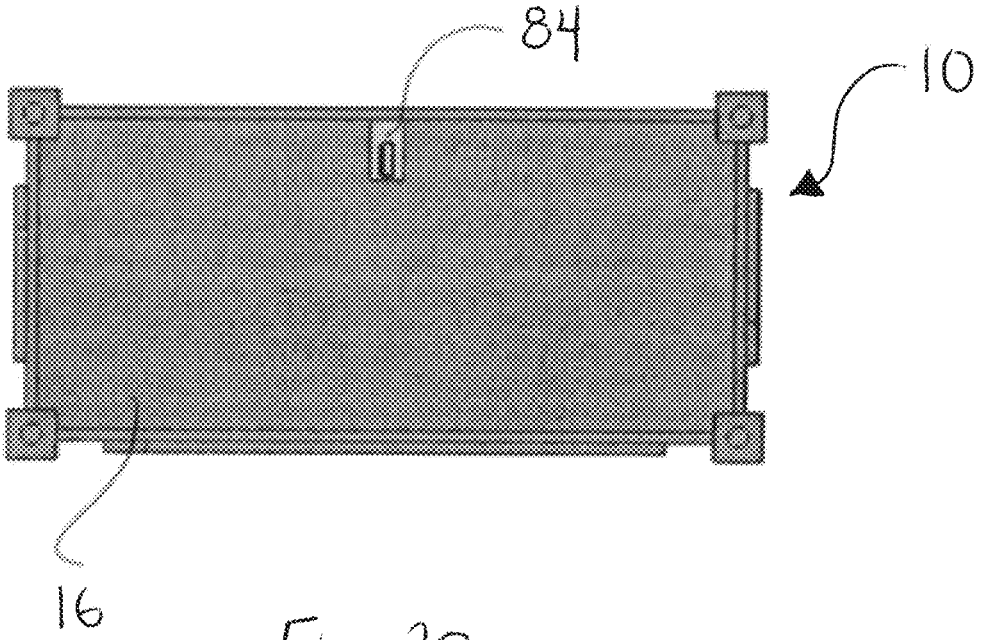
FIG. 20 is a bottom plan view of the device of FIG. 1.

As shown in FIG. 20, a biometric sensor 84 may located in the lower compartment 32, and out of view from a casual observer. The biometric sensor 84 may be in communication with the central computer 80 and may be configured to transmit information to the central computer. Such information may include, for example without limitation, biometric information such as, but not limited to, fingerprint information. A biometric sensor that reads fingerprints may be obtained from many sources, including from SparkFun (www.sparkfun.com, Boulder, Colo.). The biometric sensor 84 may either be hard-wired to the central computer 80 or communicate with the central computer 80 wirelessly. The biometric sensor 84 may be programmed to recognize multiple fingerprints, which may be from the same person or different persons. Accordingly, an authorized user may use one finger to obtain access to one of the storage areas 40, and a different fingerprint to obtain access to another storage area 40, or to the drawer 34. Some persons may only be authorized to access a single storage area or the drawer 34. One of ordinary skill in the art will appreciate that authorized permissions recognized by the biometric sensor may be tailored as desired.

The central computer 80 may be configured to prevent the motors from moving into an unlocked position until appropriate verification or identity is received from the biometric sensor 84 or another device. In other exemplary embodiments, the central computer 80 may be configured leave the device 10 in a locked position unless and until appropriate verification of identity is received from the biometric sensor 84 or other device, at which time the central computer 80 may be configured to automatically move the device 10 into an unlocked position.

The central computer 80 may be programmed to direct different types of access to the device based on the fingerprint of a user. For example, programming may dictate that if a particular user places their index finger on the sensor 84 and it is accepted, the table top 18 may slide to the left, exposing the upper right compartment 30 and allowing a user to either access items in the upper right compartment 30 or leave items in the upper right compartment 30. The same user may then place their index finger on the sensor 84 and the table top 18 will close and keep the upper right compartment 30 secure. However, if the same user places their ring finger on the sensor 84 and it is accepted, the central computer 80 may grant access to the upper left compartment 30 and may direct the movement of the table top motor 50 to move the table top 18 to the right, thereby exposing the upper left compartment 30. Similarly, a thumb print by the same user may allow access to the drawer 34.

The central computer 80 may also be programmed to give different access permissions to different users. For example, one user may only have access to the upper compartments 30, while other users may only have access to the front drawer 34. This may be done through the establishment role-based permissions, where an administrator sets up different roles and corresponding access to be executed by the central computer 80 in communication with both the biometric sensor 84 and the motors.

In some embodiments, the device 10 may be programmed to expose the upper compartments 30 and/or open the bottom drawer 34 while also sending an alert to notify security, police, or other emergency personnel that someone is in danger. For example, in an embodiment the same fingers on an approved user may allow for the same functions (e.g., each thumb opens the bottom drawer 34, each index finger slides the table top to the left exposing the upper right compartment). However, if the user uses their left hand, the device may not only allow access to the desired compartment 30 or 32 or drawer 34, but it may also send a silent alert to a police department by way of the network communications device. This may allow a user in a confrontational setting (such as a home break-in) to access the device 10 while also alerting authorities that they are in danger. One of ordinary skill in the art will recognize that the device 10 may be programmed in variety of various ways and that different types of biometric information may be used to allow access. For example, in some embodiments voice recognition or retinal scan technology may be used, as well as radio frequency identification devices ("RFID"). The voice reorganization may be utilized to accept verbal commands from the user. Such verbal commands may include, for example without limitation, commands to open, close, arm, or disarm the device 10. The RFID device may be embedded in an ordinary object such as, but not limited to, a wedding band, bracelet, or the like. Alternatively, or in addition, non-biometric devices may be utilized such as, without limitation, keypads or keyboards configured to receive a password, a lock configured to receive a key, a series of buttons configured to be depressed in a sequence, or the like.

In an exemplary embodiment the device 10 may be powered through a hardwire connection to a power source. The hardwiring may be routed through one of the legs of the chest, which also serves to keep it hidden. In some embodiments the device may also contain an internal battery backup for power outage events. In some embodiments the particular leg of the chest where the wiring is routed may be reinforced with steel or other materials to prohibit removal and/or sawing off of the leg to cut power to the device. In other embodiments the device may also have a power cord that can be plugged into an outlet. As shown in FIG. 8, in some embodiments one or more legs 20 on a device may be bored with a hole 76 to allow for the insertion of a metal screw assembly that can be used to secure the device to the floor. While in FIG. 8 the holes are only bored through a partial portion of the legs, in other exemplary embodiments the holes may be bored through the entire leg to allow metal screws and other fasteners to be inserted from the top of the leg. In still other exemplary embodiments, one or more batteries may be the primary or sole source of power.

While the embodiments of the figures could be used as a coffee table, chest, or other table in a household setting, it will be appreciated by one of ordinary skill in the art that other embodiments could be modified to be used as kitchen islands or other types of furniture in a home, office, or commercial setting, making their secure storage functions unknown to visitors and intruders. Furthermore, it will be recognized that the location and number of drawers 34 and compartments 30 and 32 may be modified as desired.

In certain embodiments the device may be remotely controlled and monitored, such as through the use of a smart phone. In such embodiments, communications between the smart phone and device may be made through the use of cell and/or internet and may be encrypted to protect security. Encryption may be achieved through use of Tor network encryption or other type of network encryption. In such embodiments, a user may receive notifications and alerts on their smart phone or other device regarding operation of the device 10. For example, without limitation, one or more users may be notified each time the device 10 is accessed, or when an attempt to access is made, with notification of whether access was allowed or denied.

Exemplary embodiments may include safety sensors installed on the table top 18 or in the upper compartments 30 to prevent the table top from moving when a hand or other object is in the way. Safety sensors may use infrared technology or other motion detecting technology.

Exemplary embodiments may include one or more vibration and/or motion sensors located in one or more positions around the device 10 that can be used to detect the presence of others around the device 10. Such embodiments may further include means to engage cameras or additional sensors located in proximity to the device 10 to visually record or otherwise monitor the actions of unauthorized persons. In one embodiment, a user can "arm" the device 10 either remotely or manually. In the "armed" mode, the device 10 will close and engage all locks. The device 10 may also detect vibration and/or motion and if detected, will cause cameras in close proximity to activate and record, as well as push video footage to smart phones and other mobile devices. This embodiment allows a user to monitor their home and know not only if an unauthorized person is in their home but can let them see what the unauthorized person is doing in their home.

In some embodiments, the central computer 80 may further comprise a GPS beacon or other location detection device that is communication with smart phone or other mobile user device. The device 10 may automatically go into "armed" mode when a user's phone (or other mobile device) is located beyond a pre-determined radius from the device 10. For example, if a user syncs their smart phone with the central computer 80 having the location detection functionality, the user can program the device to automatically arm when the user's phone is no longer within a 100-foot radius of the device 10. This feature can help ensure that the device 10 is armed when the user leaves the home and reduce the amount of user error. Those of skill in the art will recognize that any radius or other type of geofencing may be programmed. In other exemplary embodiments, the location of the device 10 may be programmed into the central computer 80 such that similar functionality may be achieved.

While in some embodiments the chest may be made primarily of wood, in other embodiments the chest may be made of metal, plastic, and other materials, and combinations thereof, as desired.

While certain exemplary systems, devices, and methods are described in detail above, the scope of the invention is not considered limited by such disclosure, and one of ordinary skill in the art would appreciate that modifications are possible without departing from the spirit of the invention. As such, it is intended that the present invention only be limited by the terms of the appended claims.

What is claimed is:

1. A locking receptacle comprising:

four sides of equal height and a bottom surface defining a generally rectangular inner cavity;

a substantially planar table top horizontally disposed above the inner cavity, said table top configured to slide bilaterally from a closed position where the table top covers the entire inner cavity to a plurality of open positions, where the inner cavity is at least partially exposed;

a first set of one or more locking devices for securing the table top in a predetermined position relative to the inner cavity;

a drawer slidably mounted to a front side of the receptacle for movement between an open position extending in front of the receptacle and a closed position in the inner cavity;

a second set of one or more locking devices for securing the drawer in the closed position;

a sensor mounted on the receptacle for receiving information about the identity of a user; and a computer in electrical communication with the sensor and comprising a processor and an electronic storage device, said electronic storage device comprising data representing an authorized user and software instructions which when executed by the processor configure the processor to receive data representing the identify of a user from the sensor and permit access to said inner cavity and said drawer if the received data matches the stored data representing an authorized user.

2. The locking receptacle of claim 1, wherein:

all of the first and second sets of locking devices are cam locks.

3. The locking receptacle of claim 1, wherein:

the receptacle is a coffee table.

4. The locking receptacle of claim 2 wherein:

each of the cam locks comprises:

an upper portion, a lower portion, and a locking mechanism located within the lower portion.

5. The locking receptacle of claim 4 wherein:

the upper portion of each of said cam locks in said first set of locking devices are located at least partially within the table top; and the lower portion of each of said cam locks in said first set of locking devices are located at least partially within one of the four sides.

6. The locking receptacle of claim 5 wherein:

said first set of locking devices comprises a first, second, third, and fourth cam lock.

7. The locking receptacle of claim 6 further comprising:

a first motor coupled to said first and second cam locks; and a second motor coupled to said third and fourth cam locks.

8. The locking receptacle of claim 7 further comprising:

a first 90 degree driver coupling said first motor to said first and second cam locks; and a second 90 degree driver coupling said second motor to said third and fourth cam locks.

9. The locking receptacle of claim 8 further comprising:

the upper portion of each of said cam locks in said second set of locking devices are located at least partially within the drawer; and the lower portion of each of said cam locks in said second set of locking devices are located at least partially within the inner cavity.

10. The locking receptacle of claim 9 further comprising:

a hex long bar extending through the respective locking mechanisms for each of said cam locks in said second set of locking devices; and a third motor coupled to said hex long bar.

11. The locking receptacle of claim 10 further comprising:

a rack located on a bottom surface of said table top;

a pinion motor positioned and configured to interact with said rack in order to cause movement of said table top between the opened and closed positions; and additional software instructions which when executed by the processor configure the processor to selectively cause movement said first motor, said second motor, and said pinion motor.

12. The locking receptacle of claim 1 wherein:

said computer further comprises a network communication device; and said electronic storage device comprises further software instructions which when executed configure the processor to transmit an alert, by way of said network communication device, to a remote device when said computer receives data representing the identify of a user from the sensor.

13. The locking receptacle of claim 1, wherein:

when the table top is in a first of the plurality of open positions a first storage area is accessible and a second storage area is not accessible, and when the table top is in a second of the plurality of open positions the first storage area is not accessible and the second storage area is accessible.

14. The locking receptacle of claim 1, wherein:

contents of the drawer cannot be accessed when the drawer is in the closed position and the table top is in one of the plurality of open positions.

15. The locking receptacle of claim 1, wherein:

the information about the identity of a user comprises biometric or non-biometric information.

16. A locking receptacle comprising:

four sides and a bottom surface defining a generally rectangular inner cavity;

a substantially planar table top horizontally disposed above the inner cavity;

at least one rail slide located on a bottom surface of said table top configured to provide sliding bi-directional movement of said table top between a closed position wherein the table top covers the entire inner cavity, and an open position wherein the inner cavity is at least partially exposed;

a first, second, third, and fourth cam lock defining a first set of cam locks and positioned to selectively secure the table top in the closed position;

a drawer slidably mounted to the front side of the receptacle for movement between an open position and a closed position;

a first and second cam lock defining a second set of cam locks and positioned to selectively secure the drawer in the closed position;

a sensor mounted on the receptacle for receiving information about the identity of a user;

a computer in electrical communication with the sensor and comprising a processor and an electronic storage device, said electronic storage device comprising data representing the identity of an authorized user and software instructions which when executed by the processor configure the processor to receive data representing the identify of a user from the sensor and permit access to said inner cavity and said drawer if the received data matches the stored data representing the identity of an authorized user; and a hex long bar located along the side of said receptacle facing opposite said drawer;

wherein each of said cam locks in said first and second set of cam locks comprises a lower portion, an upper portion, and a locking mechanism located in said lower portion;

wherein each of said upper portions of said cam locks in said first set of cam locks are located at least partially within the table top, and each of said lower portions of said cam locks are located at least partially within one of said sides of said receptacle; and wherein each of said lower portions of said cam locks in said second set of cam locks are located at least partially within said drawer; and wherein each of said locking mechanisms of said cam locks in said second set of cam locks are mounted to the hex long bar.

17. The locking receptacle of claim 16 further comprising:

a first drive shaft coupled to said locking mechanisms of said first and second cam locks in said first set of cam locks;

a first motor configured to provide rotational movement of said first drive shaft;

a second drive shaft coupled to said locking mechanisms of said third and fourth cam locks in said first set of cam locks;

a second motor configured to provide rotational movement of said second drive shaft; and a third motor coupled to the hex long bar.

18. The locking receptacle of claim 17 further comprising:

a rack located on a bottom surface of said table top;

a pinion gear positioned to engage said rack; and a pinion motor configured to provide rotational movement to the pinion gear.

19. The locking receptacle of claim 18 further comprising:

additional software instructions which when executed by the processor configure the processor to selectively cause movement of said first motor, said second motor, and said pinion motor.

20. A locking receptacle comprising:

four sides and a bottom surface defining a generally rectangular inner cavity;

a substantially planar table top horizontally disposed above the inner cavity and comprising a rack located on a bottom surface thereof;

a pinion gear coupled to a pinion motor located in said inner cavity and configured to engage said rack to move said table top between a closed position, wherein the table top covers the entire inner cavity, and an open position, wherein the inner cavity is at least partially exposed;

a first, second, third, and fourth set of cam locks defining a first set of cam locks positioned to selectively secure the table top in the closed position;

a first motor coupled to said first and second cam locks;

a second motor coupled to said third and fourth cam locks;

a drawer slidably mounted to the front side of the receptacle for movement between an open position and a closed position;

a hex long bar located behind the drawer;

a first and second cam lock defining a second set of cam locks mounted to said hex long bar and positioned to selectively secure the drawer in a closed position;

a third motor coupled to said first and second cam locks of the second set of cam locks;

a sensor mounted on the receptacle for receiving information about the identity of a user;

a computer in electrical communication with the sensor and comprising a processor and an electronic storage device, said electronic storage device comprising data representing an authorized user and software instructions which when executed by the processor configure the processor to receive data representing the identify of a user from the sensor and activate at least one of said first motor, said second motor, or said pinion motor upon a determination that the received data matches the stored data representing an authorized user.

* * * * *